United States Patent [19]

Baechler

[11] 4,014,116

[45] Mar. 29, 1977

[54] LONG-DISTANCE SKI-TRACK PLOUGHING DEVICE

[76] Inventor: Anton R. Baechler, Seeburgstrasse 10, CH-6006 Lucerne, Switzerland

[22] Filed: Aug. 25, 1975

[21] Appl. No.: 607,604

[30] Foreign Application Priority Data

Aug. 28, 1974 Switzerland ..... 011708/74

[52] U.S. Cl. ..... 37/10; 37/51; 172/188; 172/393; 172/787

[51] Int. Cl.[2] ..... E01H 4/00

[58] Field of Search ..... 37/10, 13, 41, 51, 52; 172/188, 197, 393, 198, 200, 387, 392, 393, 397, 398, 787, 779, 780

[56] References Cited

UNITED STATES PATENTS

| | | | |
|---|---|---|---|
| 649,595 | 5/1900 | Brown | 172/197 X |
| 768,170 | 8/1904 | Dorsett | 172/197 X |
| 1,007,459 | 10/1911 | Larsen | 172/393 |
| 1,176,591 | 3/1916 | Monroe | 172/397 X |
| 3,106,969 | 10/1963 | Carter | 172/197 |
| 3,246,458 | 4/1966 | Lavergne | 172/393 X |
| 3,437,061 | 4/1969 | Wells | 172/393 X |
| 3,478,827 | 11/1969 | Madson | 172/379 |
| 3,534,821 | 10/1970 | Mitchell | 172/398 X |
| 3,878,900 | 4/1975 | Boisse et al. | 172/197 X |
| 3,915,239 | 10/1975 | Hendrichon | 37/13 |

*Primary Examiner*—E. H. Eickholt
*Attorney, Agent, or Firm*—Brisebois & Kruger

[57] ABSTRACT

This invention proposes a long-distance ski-track-ploughing device comprising a track sled adapted to be towed by a vehicle in the direction of the track, the underside of the said sled being equipped with tracking elements oriented in the direction of the track. This device is characterized in that the track sled is preceded by a forward sled, joined to the track sled by means of a connecting frame to which each sled is connected pivotably by means of a horizontal axis perpendicular to the direction of the track, the said connecting frame carrying a scraper perpendicular to the direction of the track and located between the said sleds.

3 Claims, 5 Drawing Figures

LONG-DISTANCE SKI-TRACK PLOUGHING DEVICE

The invention relates to a long-distance ski-track-ploughing device comprising a track sled adapted to be towed by a vehicle, in the direction of the track, the underside of the said sled being equipped with tracking elements oriented in the direction of the track.

No great problems arise when known devices of this kind are used in soft, easily compacted snow, i.e. fresh snow, since the tracking elements are usually designed with means for displacing the snow and/or with ejector blades having a ploughing action. As soon as the snow becomes iced or acquires a crust, however, ploughing a track becoms a problem, since either the displacement elements or ejector blades fail to penetrate properly into the snow or, if a heavy vertical load is applied, the snow is broken up into sheets and the track grooves produced are inadequate. If the surface consists of ice, no track can be produced. The problem becomes even more difficult when an existing track, which has worn out and becomes iced-over, is to be restored, since the displacement elements are quite unable to cope with this work. In such cases it has hitherto been necessary to leave the existing track as it is and, if possible, to plough a new track alongside. Fresh snow, when available, may also be shovelled into the existing track, but this usually requires a considerable amount of labour and is therefore costly.

It is the purpose of the invention to provide a long-distance track-ploughing device which may be used in fresh snow or iced snow, or even for restoring a worn-out and iced-over track.

According to the invention, this purpose is achieved by means of a long-distance track-ploughing device of the type mentioned above comprising a track sled adapted to be towed by a vehicle in the direction of the track, the underside of the said sled being equipped with tracing elements oriented in the direction of the track, characterized in that the track sled is preceded by a forward sled joined to the track sled by means of a connecting frame to which each sled is connected pivotably by means of a horizontal axis perpendicular to the direction of the track, the said connecting frame carrying a scraper perpendicular to the direction of the track and located between the said sleds.

According to a preferred embodiment, this scraper, which is preferably adjustable in height in relation to the connecting frame, is equipped with a serrated cutting edge and more particularly with a cutting edge consisting of a row of individual blades similar to those on a reaper. This makes it possible to pierce the snow between the sleds to any desired depth, to lift it, to bank it up temporarily, and to allow it to fall back again behind the said scraper. It is important to note that the two sleds act as reference surfaces, i.e. as a guide, to the scraper located between them and attached to the connecting frame, the effect of which is to top-off the crests and fill-in the troughs as the scraper travels over and through the snow. If the surface of the snow is not too heavily crusted or iced, this procedure loosens and mixes the snow so well that the tracking elements on the sleds can easily restore an existing track or plough a new track.

Under heavy icing conditions, however, there is a danger of the scraper producing large sheets which cannot be properly formed by the tracking elements. In such a case, according to another preferred embodiment, the undersides of the forward sleds carry a number of vertical blades oriented in the direction of the track. These vertical blades can easily pierce through heavily iced snow, dividing it into more or less longitudinal strips which are then undercut, lifted, broken and banked up by the scraper before being allowed to fall back again behind the said scraper. This conditions the snow extremely well and also makes it possible to restore heavily compacted, worn-out, and iced tracks. Depending upon the height to which the scraper is adjusted, more or less of the underlying soft snow can be mixed with the hard top layer.

It is not uncommon for long-distance trails to cross a cleared road where the tracking elements and blades of the device, and/or the cleared road, could be damaged. According to another preferred embodiment of the invention, this may be avoided by fitting the upper surfaces of the forward sleds with additional runners and the track sled with lateral guides. When the said sleds are folded upwards, out of their normal operating position, about their centres of rotation on the connecting frame, the additional runners project downwardly to an extent such that only they and the lateral guides of the main sleds come into contact with the road, whereas the blades and tracking elements are lifted out of the way.

The invention will be now better understood with reference to the following description of one embodiment, references being made to accompanying drawings wherein.

Figure 1:
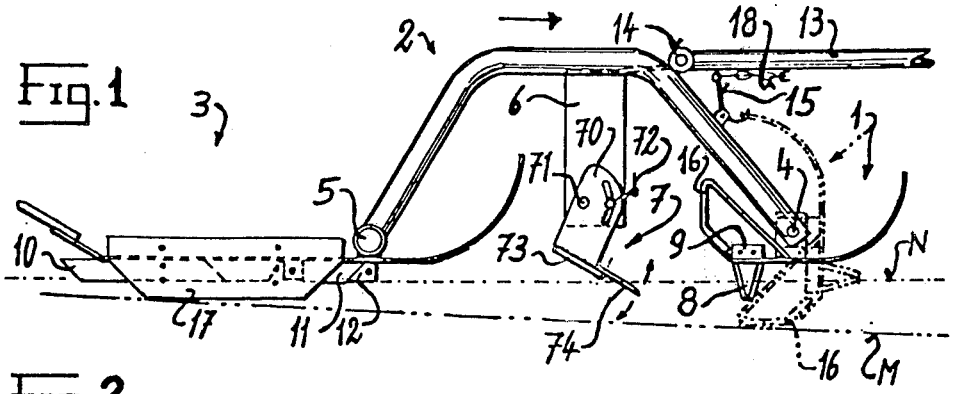
FIG. 1 is a side elevation of a long-distance track-ploughing device according to the invention.
Figure 5:
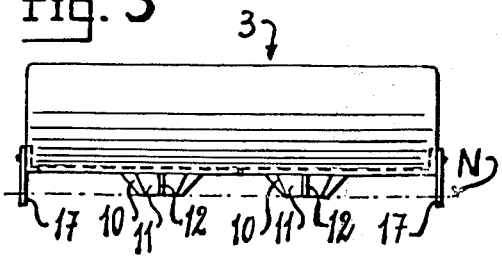
FIG. 5 is a front elevation of the track sled.
Figure 3:
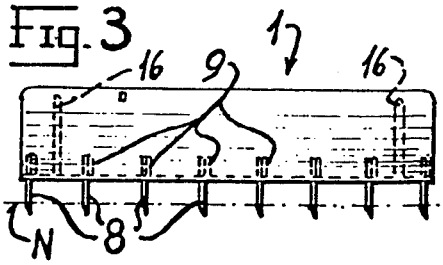
FIG. 3 is a front elevation of the forward sled.
Figure 4:
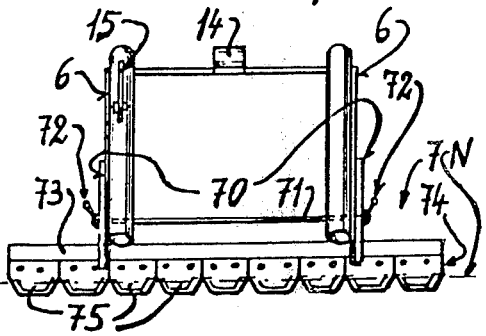
FIG. 4 is a front elevation of the connecting frame and scraper.

In FIGS. 1, 3 and 5, dotted line N indicates the surface tangential to the undersides of tracking elements 10 of track sled 3. This provides a reference level for these three figures.

The long-distance ski-track-ploughing device illustrated consists of a forward sled 1, a connecting frame 2 and a track sled 3, the said sleds being attached pivotably to the said connecting frame by horizontal axis 4 and 5 respectively.

A scraper 7 is mounted on connecting frame 2 by two brackets 6 and lateral members 70, the said scraper being pivotable about an axis 71 and being locked in position by locking means 72. As may be gathered from FIG. 1 in particular, the height of scraper 7 in relation to level N, and the angle of the said scraper, may be adjusted simultaneously so that the angle of the scraper in relation to the ground becomes steeper as the depth of engagement increases. This ensures uniformly smooth travel of the scraper and thorough mixing of the snow which the said scraper undercuts, lifts, banks up, and allows to fall back again.

In order to facilitate and improve the curting and mixing of the snow, scraper 7 in this case consists of a carrier 73 which is rigidly connected to lateral members 70 and to which is screwed serrated blade 74 consisting of individual reaper blades 75 arranged side by side and ground at their front ends.

In order to make scraper 7 as effective as possible, vertical blades 8, running in the direction of the track, are fitted to forward sled 1. These blades may also be in the form of reaper blades screwed to sled 1 to 9 so that they can be replaced. No fixed relationship is required between blades 8 and 75, as it appears to exist in the drawing, although in both cases it is desirable that the blades be distributed as uniformly as possible.

The underside of track sled 3 is fitted with tracking elements 10 of trapezoidal cross-section, arranged side by side, and running in the direction of the track, the front of each element being wedge-shaped while the rear has a sloping surface in order to facilitate possible travel in reverse for a short distance. Located in front of each tracking element 10 is a trapezoidal wedge 11, each of which has a blade 12 which projects from its front edge, the front of the said blades usually being blunt, vertical, replaceable and turnable. Under the most favourable snow conditions, track sled 3 may be attached by means of axis 5 directly to a tractor tow-bar (not shown). In this case blades 12 would remove a thin layer of ice, wedges 11 would produce track grooves of the required depth but rather too narrow and with walls rather too steep, while tracking elements 10 would widen these grooves and finally compact them. The shape of these elements is such that the binding projecting from a ski travelling along the bottom of the groove would not come into contact with the sides of the groove. This objective is achieved by the angle between the sides and bottom of the said tracking element, which is of the order of 50°, and by the remaining dimensions of the said element. The precompacting effected by wedges 11 produces a particularly satisfactory track. Wedges 11 and tracking element 10 perform the same function, in the device according to the invention, when the snow has been prepared by blades 8 and 75.

Figure 2:
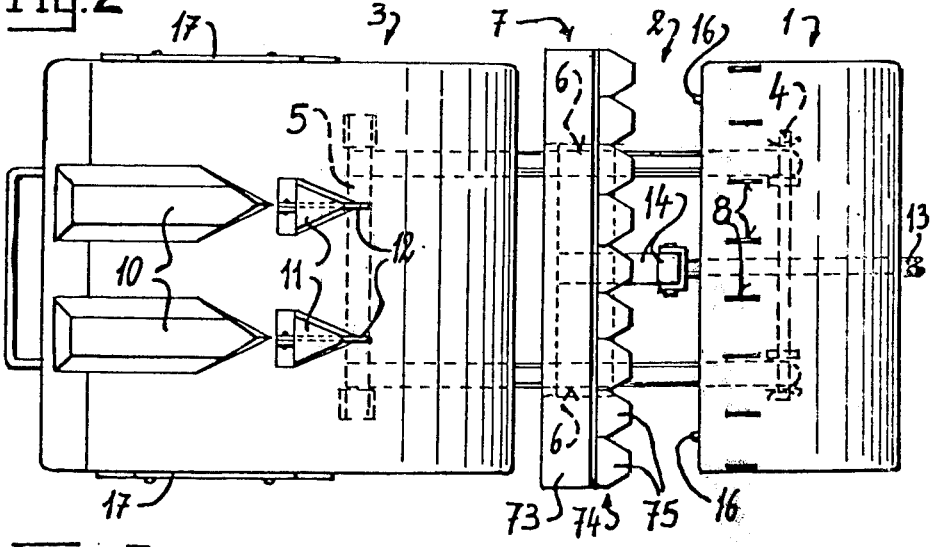
FIG. 2 is a view of this device from below.

The long-distance track-ploughing device is attached to a towing vehicle (not shown) by tow-bar 13 shown in FIGS. 1 and 2, the said tow-bar being hinged to connecting frame 2 by intermediate part 14. This tow-bar may be a part of a combination tow-bar which allows several track-ploughing devices to be towed simultaneously and in parallel by a single tractor.

When the ploughing devices reaches a cleared road, the front sled is rotated about axis 4 from its normal operating position to the position shown in dotted lines and is suspended from connecting frame 2 by means of locking hook 15. The sled is thus lifted by additional skids 16, so called runners so far above the level of the road, indicated by line M in FIG. 1, that only these additional skids 16 and stabilizing guides 17 of track sled 3 are in contact with line M. This prevents the road from being damaged by the ploughing device or the ploughing device itself being damaged. After the road has been crossed, sled 1 may be released by means of chain 18, which releases hook 15, and the forward motion of the ploughing device automatically returns the said sled to its operative positon.

The normal runners of sleds 1 and 3 are in the form of bent plates, the width of which corresponds to that of the track, so-called "stick-track". Their main function is to smooth the track.

What is claimed is:

1. In a long-distance ski-track-ploughing device comprising a track sled adapted to be towed by a vehicle in the direction of the track, tracking elements on the underside of said sled oriented in the direction of the track, a forward sled joined to the track sled by means of a connecting frame, means pivotally connecting each sled to said frame to swing about a horizontal axis perpendicular to the direction of the track, and a scraper carried by said connecting frame perpendicular to the direction of the track and located between the said sleds, the improvement which comprises a plurality of lateral guides on the track sled, a plurality of vertical blades fixed to the underside of the forward sled oriented in the direction of the track, and additional runners fixed to at least a portion of said forward sled, said runners being so positioned that when said forward sled is swung about the means pivotally connecting it to said frame, from an operative position which its blade-carrying portion is substantially parallel to the track to an inoperative positon in which said blade-carrying portion is at an angle to the track, said blades and scraper lie above a plane containing the lowermost surfaces of said runners and said lateral guides.

2. In a long-distance ski-track-ploughing device comprising a track sled adapted to be towed by a vehicle in the direction of the track, tracking elements on the underside of said sled oriented in the direction of the track, a forward sled joined to the track sled by means of a connecting frame, means pivotally connecting each sled to said frame to swing about a horizontal axis perpendicular to the direction of the track, and a scraper carried by said connecting frame perpendicular to the direction of the track and located between the said sleds, the improvement which comprises tracking elements on said track sled, each having a trapezoidal cross-section, and with narrower cross-sectionally trapezoidal wedges located in front of each tracking element, which wedges have a forwardly-projecting nose blade, a prism-shaped central portion and a wedge shaped tip portion.

3. A long-distance ski-track-ploughing device according to claim 2 in which the slope of the legs of the trapezium in the cross-section of the wedges is steeper than in the cross-section of the tracking element.

* * * * *